United States Patent [19]

Schmidlin

[11] Patent Number: 4,810,604

[45] Date of Patent: Mar. 7, 1989

[54] COMBINATION XEROGRAPHIC AND DIRECT ELECTROSTATIC PRINTING APPARATUS FOR HIGHLIGHT COLOR IMAGING

[75] Inventor: Fred W. Schmidlin, Pittsford, N.Y.

[73] Assignee: Xerox Corporation, Stamford, Conn.

[21] Appl. No.: 102,965

[22] Filed: Sep. 30, 1987

[51] Int. Cl.[4] ..... G03G 13/01; G03G 13/22; G03G 15/01; G03G 15/22

[52] U.S. Cl. ..... 430/42; 430/31; 430/54; 346/153.1; 346/157; 355/3 R; 355/4; 427/14.1

[58] Field of Search ..... 430/31, 42, 54; 427/14.1; 346/153.1, 157, 159, 160; 355/3 R, 3 TR, 4

[56] References Cited

U.S. PATENT DOCUMENTS

| | | | |
|---|---|---|---|
| 4,078,929 | 3/1978 | Gundlach . | |
| 4,124,286 | 11/1978 | Barasch | 355/3 R |
| 4,251,152 | 2/1981 | Miyakawa et al. | 346/153.1 X |
| 4,392,736 | 7/1983 | Nakamine | 355/3 R |
| 4,599,285 | 7/1986 | Haneda et al. | 430/54 |
| 4,660,059 | 4/1987 | O'Brien | 346/157 |
| 4,697,913 | 10/1987 | Kuramoto et al. | 355/3 R |

*Primary Examiner*—Roland E. Martin

[57] ABSTRACT

A combination Xerograhic-DEP printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing.

8 Claims, 2 Drawing Sheets

COMBINATION XEROGRAPHIC AND DIRECT ELECTROSTATIC PRINTING APPARATUS FOR HIGHLIGHT COLOR IMAGING

BACKGROUND OF THE INVENTION

This invention relates generally to the rendering of latent electrostatic images visible using multiple colors of dry toner or developer and more particularly to apparatus for forming highlight color images without scavenging and re-development of a first developed image.

The invention can be utilized in the art of xerography or in the printing arts. In practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

These charge patterns are made visible by developing them with one or more toners. The toners are generally colored powders which adhere to the change patterns by electrostatic attraction.

The developed images are then fixed to the imaging surface or transferred to a receiving substrate such as plain paper to which they are fixed by suitable fusing techniques.

The concept plural color or highlight color xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential ($V_{cad}$ or $V_{ddp}$), the other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

When using conventional magnetic brush developer structures for development of images subsequent to the first developed image it has been observed that scavenging and re-development of the first developed image results. Furthermore, toner from the first developer system accumulates in the second developer housing and conventional magnetic brushes require at least double the sensitivity because they must develop less than half strength images.

BRIEF SUMMARY OF THE INVENTION

Briefly, the present invention uses a magnetic brush developer apparatus for developing the first of a plurality of images. The image developed by the magnetic brush is preferably formed with laser imaging techniques but may be formed using conventional optical scanning. The images thus formed, unlike those formed using tri-level imaging, have the full range of voltage associated with conventional xerography.

A second or successive image is created using a second imaging process. After the first image is formed, it is transferred to a copy substrate. The second image is then formed on the substrate, either before or after fusing of the first image on the copy substrate.

The second image is preferably formed using an imaging technique known as direct electrostatic printing (DEP). In this type of imaging, toner images are formed on the copy substrate through propulsion of toner, in image configuration, across a gap onto the copy substrate. Consequently, there is no physical contact of the first developed image by the toner used in the DEP imaging process.

Also, my combined Xerographic-DEP system facilitates utilization of the full quality and latitude available in conventional xerography to produce the information bearing part of the image (without sacrifices inherent in tri-level imaging) while utilizing the convenience, cost and reliability advantages of DEP to produce the color bearing part of an image.

DETAILED DESCRIPTION OF THE PREFERRED EMBODIMENT OF THE INVENTION

Figure 1:
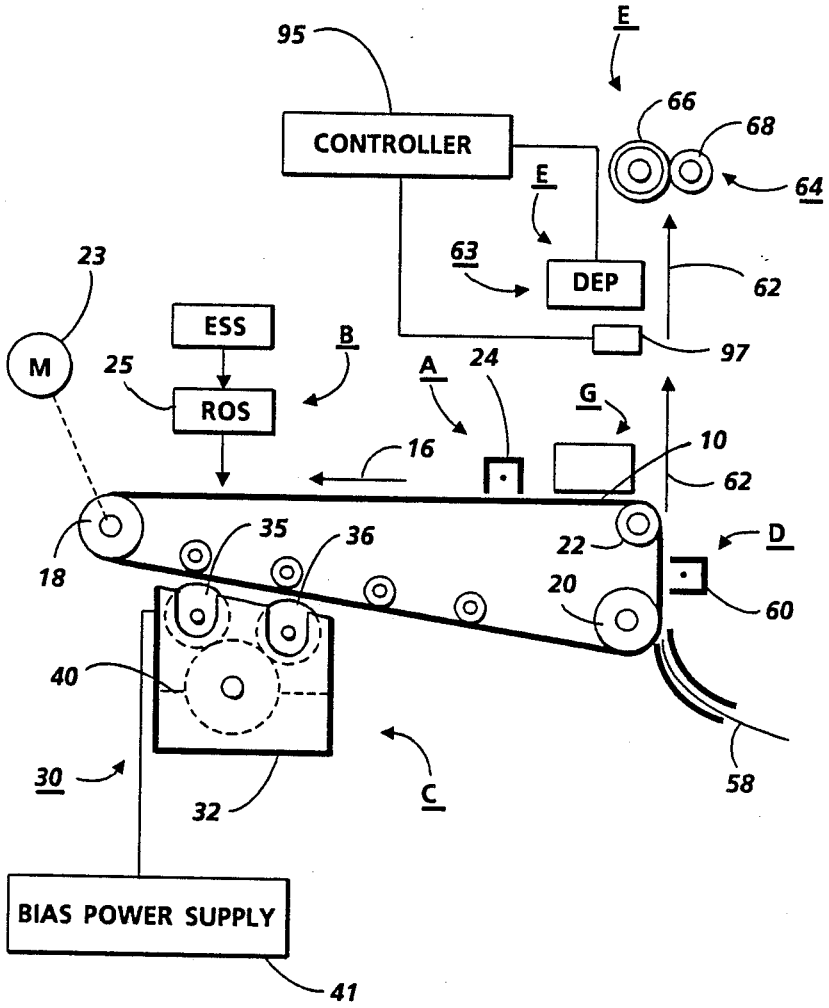
FIG. 1 is a schematic illustration of an electrostatic printing apparatus representing the present invention.

As shown in FIG. 1, a printing machine comprising my invention may utilize a charge retentive member in the form of a photoconductive belt 10 consisting of a photocondutive surface and an electrically conductive substrate and mounted for movement past a charging station A, an exposure B, developer stations C, transfer station D and cleaning station G. Belt 10 moves in the direction of arrow 16 to advance successive portions thereof sequentially through the various processing stations disposed about the path of movement thereof.

Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Alternatively, the ROS could be replaced by a conventional xerographic exposure device.

At a development station C, a magnetic brush development system, indicated generally by the reference numeral 30 advances developer materials into contact with the electrostatic latent image. The development system 30 comprises a developer housing 32 including a pair of magnetic brush developer rollers 35 and 36. Appropriate developer biasing is accomplished via a bias power supply 41 electrically connected to developer housing 32.

The magnetic brush rolls 35 and 36 may comprise any conventional structure known in the art that provides a magnetic field that forms the developer material in the housing 32 into a brush-like configuration in the development zone between the rolls and the charge retentive surface. This arrangement effects development of the ROS or optically formed image contained on the charge retentive surface in a well known manner.

The housing 32 contains developer with black toner 40 having triboelectric properties such that the toner is driven to the areas of the latent image by the electrostatic field (development field) between the photoreceptor and the electrically biased development rolls.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (now shown) which advances the sheet to a direct electrostatic printer 63 positioned at station E.

Figure 2:
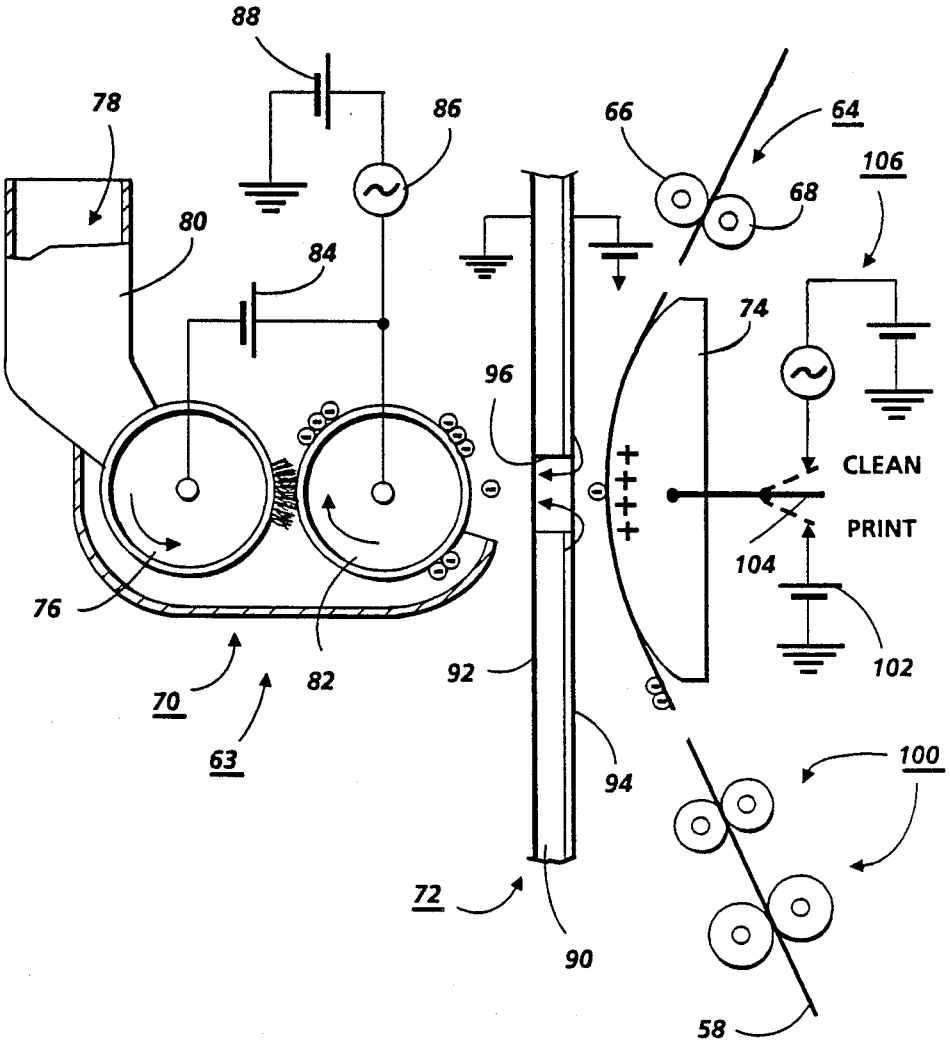
FIG. 2 is a schematic representation of a direct electrostatic printing device forming a part of the apparatus disclosed in FIG. 1.

The printer apparatus 63, as viewed in FIG. 2, includes a developer delivery system generally indicated by reference character 70, a printhead structure 72 and a backing electrode or shoe 74.

The developer delivery system 70 includes a conventional magnetic brush 76 supported for rotation adjacent a supply 78 of developer contained in a hopper 80. The developer contained in the supply 78 is a different color from the developer 40. Thus, it serves for forming a contrasting or highlight color image on the copy substrate 58. A developer donor roll 82 is supported for rotation intermediate the magnetic brush 76 and the printhead structure 72. The donor roll structure which is preferably coated with Teflon-S (Trademark of E.I. duPont) is spaced from the printhead approximately 0.003 to 0.015 inch. Teflon-S is a tetrafluoroethylene fluorocarbon polymer that is loaded with carbon black. The magnetic brush has a DC bias of about 100 volts applied thereto via a DC voltage source 84. An AC voltage of about 400 volts provided by source 86 with a DC bias of 20 volts provided by source 88 is applied to the donor roll 82. The applied voltages are effective to cause attraction of developer to the brush 76 and to cause transfer of a monolayer of toner to the donor roll 82 from the brush 76. The monolayer is subsequently jumped to the vicinity of the apertures of the printhead. The 20 volts DC bias precludes collection of righ sign toner on the shield electrode of the printhead.

The developer preferably comprises any suitable insulative non-magnetic toner/carrier combination having Aerosil (Trademark of Degussa, Inc.) contained therein in an amount in the neighborhood of ½% by weight and also having zinc stearate contained therein in an amount in the neighborhood of 1% by weight.

The foregoing developer delivery or supply system provides an improved arrangement for controlling the mass and charge of the toner and, in particular, the percentage of wrong sign toner that is utimately presented to the printhead 72. The toner/carrier mix used results in favorable charge distribution in the toner. This results in a reduction in the contamination rate of the printhead.

The printhead structure 72 comprises a layered member including an electrically insulative base member 90 fabricated from a polyimide film approximately 0.001 inch thick. The base member is clad on the one side thereof with a continuous conductive layer or shield 92 of aluminum which is approximately one micron thick. The opposite side of the base member 90 carries segmented conductive layer 94 thereon which is fabricated from aluminum. A plurality of holes or apertures 96 (only one of which is shown) approximately 0.007 inch in diameter are provided in the layered structure in a pattern suitable for use in recording information. The apertures form an electrode array of individually addressable electrodes. With the shield grounded and zero volts applied to an addressable electrode, toner is propelled through the aperture associated with that electrode. The apertures extends through the base 90 and the conductive layers 92 and 94.

With a negative 350 volts applied to an addressable electrode, toner is prevented from being propelled through the aperture. Image intensity can be varied by adjusting the voltage on the control electrodes between 0 and minus 350 volts. Addressing of the individual electrodes can be effected in any well known manner know in the art of printing using electronically addressable printing elements. The addressing of the electrodes is synchronized with the arrival of the copy substrate at the DEP station, E after detection of the copy substrate 58 by a sensor 97. The output signal from the sensor 97 is transmitted to the controller 95 to initiate operation of the printer 63.

The electrode or shoe 74 has an arcuate shape as shown but as will be appreciated, the present invention is not limited by such a configuration. The shoe which is positioned on the opposite side of the plain paper copy substrate 58 from the printhead deflects the recording substrate in order to provide an extended area of contact between the medium and the shoe.

The substrate or recording medium 58 may comprise cut sheets of paper fed from a supply tray (not shown). The sheets of paper are spaced from the printhead 72 a distance in the order of 0.005 to 0.030 inch as they pass therebetween. The sheets 58 are transported in contact with the shoe 74 via edge transport roll pairs 100.

During printing the shoe 74 is electrically biased to a DC potential of approximately 400 volts via a DC voltage source 102.

Periodically, a switch 104 is actuated in the absence of a sheet of paper between the printhead and the shoe such that a DC biased AC power supply 106 is connected to the the shoe 74 to effect cleaning of the printhead. The voltage supplied by the source 102 is of the same frequency as that (i.e. source 86) used to jump the toner from the toner supply system but it is 180 degrees out of phase with it. This causes the toner in the gap between the paper and the printhead to oscillate and bombard the printhead.

Momentum transfer between the oscillating toner and any toner on the control electrodes of the printhead causes the toner on the control electrodes to become dislodged. The toner so dislodged is deposited on the substrates subsequently passed over the shoe 74.

Fusing station F includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station G.

Subsequent to cleaning, a discharge lamp (not shown) floods the photoconductive surface with light to dissipate any residual electrostatic charge remaining prior to the charging thereof for the successive imaging cycle.

What is claimed is:

1. The method of forming two different types of images on a substrate in a single pass, said method including the following steps in the order listed:

forming latent images on a charge retentive surface which images have the full range of voltage associated with conventional xerography;

applying a first developer to said latent images to thereby render them visible;

transferring said developed images to a substrate; and using a supply of second developer having properties different from said first developer, forming powder images on said substrate without said second developer contacting the images on said substrate which are delineated by said first developer thereby precluding scavenging of the images delineated by said first developer by said second developer and contamination of said supply of second developer by said first developer.

2. The method according to claim 1 wherein said supply or second developer uses a direct electrostatic printer.

3. The method according to claim 2 including fusing said images to said substrate.

4. The method according to claim 3 including using first and second developers which are different colors.

5. Apparatus for forming two different types of images on a substrate in a single pass, said apparatus comprising:

means for forming latent images on a charge retentive surface, said images having the full range of voltage associated with conventional xerography;

means for applying a first developer to said latent images to thereby render them visible;

means for transferring said developed images to a substrate; and means including a supply of second developer having properties different from said first developer for forming powder images on said substrate without said second developer contacting the images on said substrate which are delineated by said first developer thereby precluding scavenging of the images delineated by said first developer by said second developer and contamination of said supply of second developer by said first developer.

6. Apparatus according to claim 5 wherein said means including a supply of second developer comprises a direct electrostatic printer.

7. Apparatus according to claim 6 including means for fusing said images to said substrate.

8. Apparatus according to claim 7 wherein said first and second developers comprise different colors.

* * * * *